United States Patent [19]

Otsuka et al.

[11] Patent Number: 4,900,987

[45] Date of Patent: Feb. 13, 1990

[54] METHOD FOR DRIVING A GAS DISCHARGE DISPLAY PANEL

[75] Inventors: Akira Otsuka, Zama; Kenji Horio, Kawasaki; Tsuyoshi Tanioka, Musashino, all of Japan

[73] Assignee: Fujitsu Limited, Kawasaki, Japan

[21] Appl. No.: 58,633

[22] Filed: Jun. 2, 1987

Related U.S. Application Data

[63] Continuation of Ser. No. 678,677, Dec. 5, 1984, abandoned.

[30] Foreign Application Priority Data

Dec. 9, 1983 [JP] Japan ..... 58-233129
Aug. 9, 1984 [JP] Japan ..... 59-166805

[51] Int. Cl.[4] ..... G09F 9/00
[52] U.S. Cl. ..... 315/169.4; 340/758
[58] Field of Search ..... 315/169.4, 169.2; 340/776, 777, 805, 713, 714, 758

[56] References Cited

U.S. PATENT DOCUMENTS 3,811,124 5/1974 Kleen et al. ..... 340/778
3,879,634 4/1975 Pfaender et al. ..... 340/714
3,969,718 7/1976 Strom ..... 340/776
3,973,253 8/1976 Criscimagna et al. ..... 340/714
4,045,790 8/1977 Miller ..... 340/758
4,302,756 11/1981 Frankland ..... 340/776
4,611,203 9/1986 Criscimagna et al. ..... 340/773
4,684,849 8/1987 Otsuka et al. ..... 315/169.4

FOREIGN PATENT DOCUMENTS 0155488 9/1985 European Pat. Off. .
0157248 10/1985 European Pat. Off. .
0160455 11/1985 European Pat. Off. .
3133785 10/1983 Fed. Rep. of Germany .
5846388 3/1983 Japan .

*Primary Examiner*—Robert L. Griffin
*Assistant Examiner*—T. Salindong
*Attorney, Agent, or Firm*—Staas & Halsey

[57] ABSTRACT

In a gas discharge display panel, first and second driving electrodes are capacitively coupled to each display electrode on at least one of two substrates. The first and second driving electrodes of the display electrodes are formed by a first group of driving electrodes and a second group of driving electrodes by connecting the first and second driving electrodes as a plurality of groups. Specified display electrodes are controlled by selecting the first and second electrodes at the same time. The method for driving the gas discharge display panel includes the steps of discharging all dots in one selected line of the discharge electrodes which are to be written, and of erasing selected dots which are not to be written.

19 Claims, 7 Drawing Sheets

Fig. 2
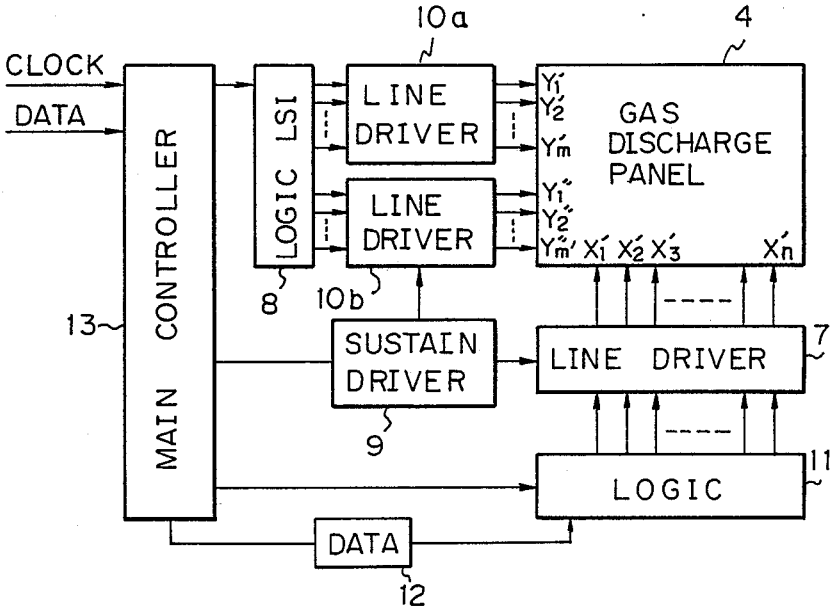
Fig.4A X
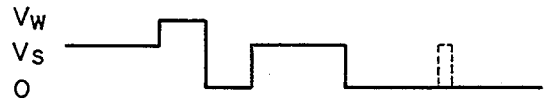
Fig.4B Y
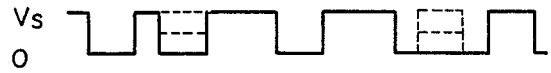
Fig.4C X-Y
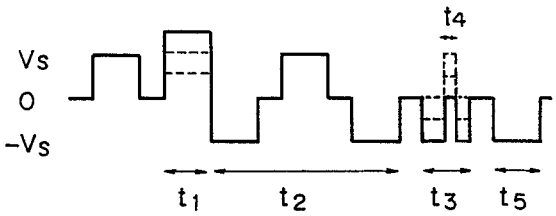

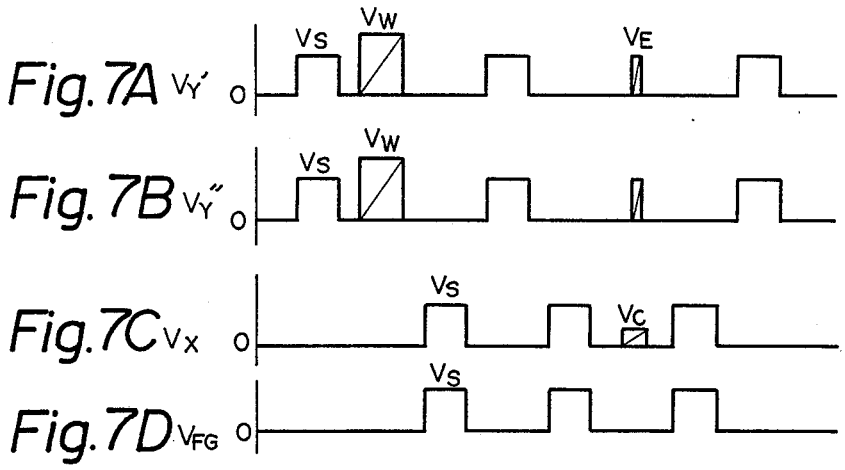
Fig. 8
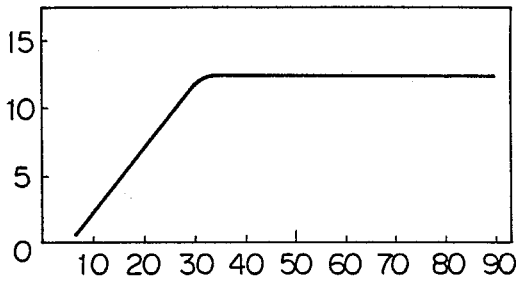

Fig. 9
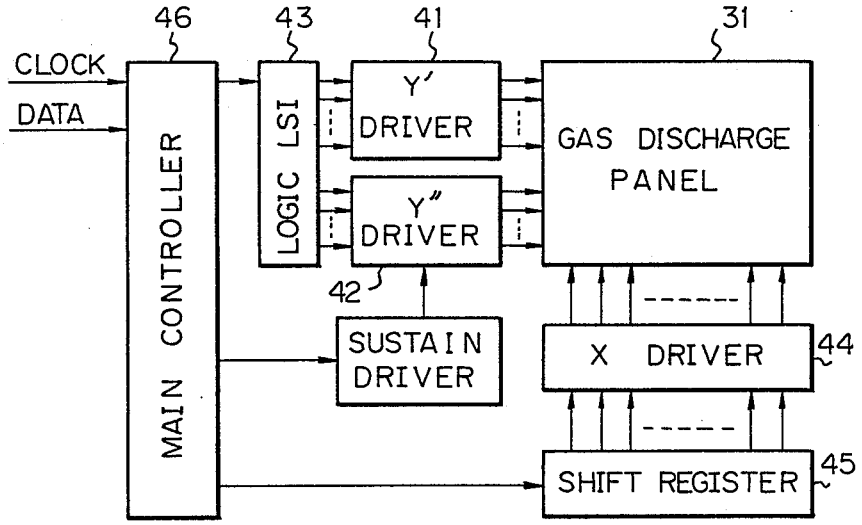
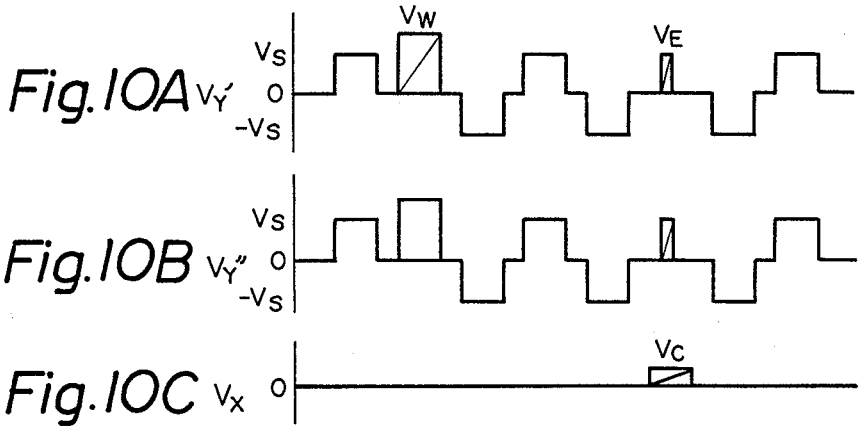

METHOD FOR DRIVING A GAS DISCHARGE DISPLAY PANEL

This is a continuation of co-pending application Ser. No. 678,677 filed on Dec. 5, 1984, now abandoned.

BACKGROUND OF THE INVENTION

The present invention relates to a gas discharge display panel using a large number of gas cells in which an inactive gas is sealed and light emission from the cells is caused by interaction between the gas and electrodes included therein, in particular, it relates to a method for driving a gas discharge display panel by using a time division drive.

Recently, display panels are widely used in terminals such as measuring apparatuses, calculators, and computers as a device for displaying figures, letters, and symbols. Light emitting diodes (LEDs), liquid crystals, and discharge cells are among the elements used in such display panels. However, in these applications, it has been found that the quality of a monolithic LED array and the color or light output thereof is not uniform, and that liquid crystals are affected by peripheral brightness, reducing the effectiveness of these elements.

In view of the above, attention has been drawn recently to gas discharge tubes, which can produce a large amount of light emission through molecular interaction with electrodes in the tube, caused by the application of an electric field to a gas sealed within the tube.

In general, a gas discharge panel using many discharge cells containing gas is comprised of two glass plates with parallel electrodes provided inside the glass plates at right angles to each other, and a mixed inactive gas such as neon or argon is contained under pressure between the electrodes, thus forming a discharge tube at a crossing point of the above parallel electrodes. That is, the discharge cells are positioned in a dot arrangement.

When a voltage is applied between both electrodes of the gas discharge cells, a discharge is caused by a reaction of the inactive gas sealed between the electrodes, and the light produced by the discharge is externally output. In particular, in AC type gas discharge cells in which an alternating voltage is applied between the electrodes, when voltage beyond a minimum discharge starting voltage for the discharge cell is applied between the electrodes, discharge is started. The discharge is maintained and the light emission is sustained by wall charges formed in the discharge cell by the first discharge when an alternating voltage having a maximum voltage lower than the discharge voltage is applied.

To reduce the number of drive electrodes needed in such a gas discharge display panel, the panel is driven by time-division, as described in detail later. However, when the gas discharge display panel is driven by the above method, the electrodes of the display panel are multiplexed by the time division during the writing operation, and the voltage is applied to the electrodes via a condenser at each end of the electrode. Therefore, when the voltage applied at both input terminals of an electrode is for example 0 V and 90 V, an intermediate voltage of approximately 45 V sometimes appears on the electrode, because the electrodes are multiplex driven by the condensers. This state is called a half-selection voltage, and is similar to a state in which the voltage application is erased, that is, the wall charges become zero, so that the display point, i.e., the light-emitting point, disappears. In other words, when the voltage applied to, for example selected X electrodes is 140 V and the voltage applied to, for example, Y electrodes, is 0 V, the information may be written. However, if the voltage, for example, 45 V, is applied to the Y electrodes, by half-selection, the voltage difference between the Y electrodes and non-selected X electrodes becomes an erase voltage. Therefore, the light-emitting point, which should be maintained, is erased.

As mentioned above, in the driving circuit of the AC type gas discharge panel, a method has been proposed for decreasing the number of driving circuits by using multiplexed driving, such as a discharge shift system. However, in this method, the driving voltage is high, and thus a high voltage driving circuit is required. Further, when the multiplexing is increased, the operating speed is decreased.

SUMMARY OF THE INVENTION

The present invention is provided to remove the above-mentioned drawbacks, in that the object of the present invention is to provide a method for driving the gas discharge display panel which simplifies the driving circuit for the gas discharge display panel multiplexed by the capacitor coupling, which can enlarge range of the discharge voltage and increase the number of gas discharge cells used in the gas discharge display panel, and which can provide a proper display when both X and Y electrodes are subject to multiplexing.

Another object of the present invention is to provide an alternating (AC) type gas discharge display apparatus, in which the driving circuit is miniaturized.

The above-mentioned objects are achieved by a gas discharge display panel in which first and second driving electrodes are capacitively coupled to each display electrode on at least one of the substrates, wherein the first and second driving electrodes of the display electrodes are composed of a first group of driving electrodes and a second group of driving electrodes by connecting the first and second driving electrodes to a plurality of groups, and specified display electrodes are controlled by selecting the first and second electrodes simultaneously. The method for driving the gas discharge display panel comprises the steps of a first step for discharging all dots in one line of the discharge electrodes to be written, and a second step for erasing dots which are not to be written.

Further features and advantages of the present invention will be apparent from the ensuing description with reference to the accompanying drawings to which, however, the scope of the invention is in no way limited.

BRIEF EXPLANATION OF THE DRAWINGS

FIG. 2 is a block diagram explaining the method for driving a gas discharge display panel according to the present invention;

FIGS. 4A, 4B, and 4C are timing charts explaining the method for driving a gas discharge display panel according to the present invention;

FIGS. 7A to 7D show timing charts explaining the method shown in FIG. 6;

FIG. 8 is a diagram showing an operation margin in the method according to the present invention;

FIG. 9 shows a block diagram explaining still another method according to the present invention; and FIGS. 10A to 10C show timing charts explaining the method shown in FIG. 9.

DESCRIPTION OF THE PREFERRED EMBODIMENTS

Figure 1:
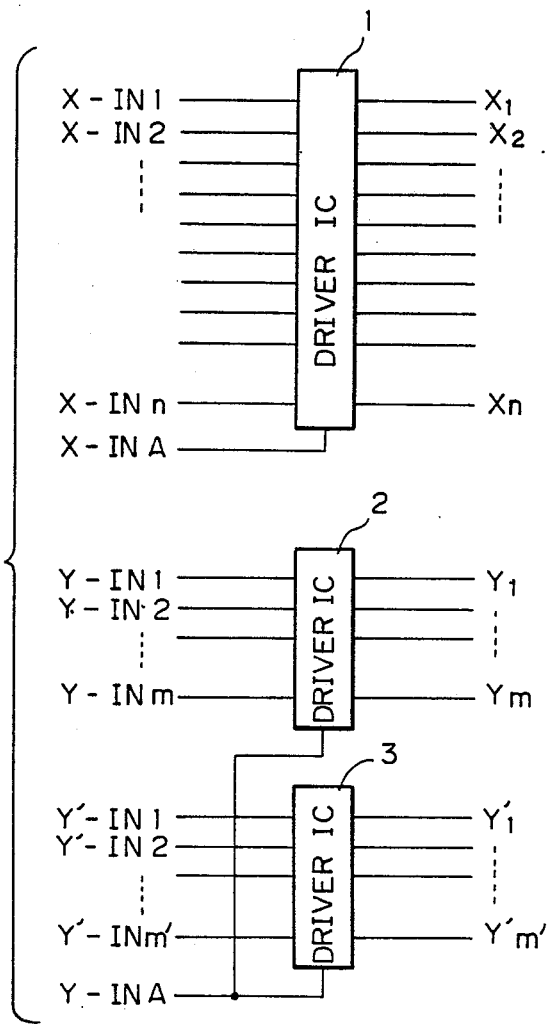
FIG. 1 shows the construction of the circuit for explaining a prior art method for driving a gas discharge display panel.

FIG. 1 is a diagram explaining the method for driving a prior art gas discharge display panel having a large number of gas discharge cells. Output terminals $X_l \sim X_n$ of a driver IC 1 are connected to X electrodes in the display panel, and output terminals $Y_l \sim Y_m$, $Y'_l \sim Y'_m$, of driver ICs 2 and 3 are similarly connected to Y electrodes in the display panel. Input terminals $Y-1N_l \sim Y-1N_m$ and $Y'-1N_l \sim Y'-1N_m$, of the driver ICs 2 and 3 receive signals that are multiplexed by time division, to decrease the number of drivers. By these input signals, the driver ICs 2 and 3 output the necessary voltage for driving the gas discharge cells of the display panel from output signal terminals $Y_l \sim Y_m$, $Y'_l \sim Y'_m$, to input terminals of each display panel.

The voltage input to the display panel is applied to the Y electrodes of the display panel. At this time, the output terminals $Y_l \sim Y_m$, $Y'_l \sim Y'_m$, of the driver ICs 2 and 3, and the Y electrodes of the display panel, are connected via each condenser as a matrix.

On the other hand, the driver IC 1 outputs the necessary voltage for driving the gas discharge tubes of the display panel according to data signals including information such as figures, letters, ect. which is input from the input terminals $X-1N_l \sim X-1N_n$ of the driver IC 1, to display this information on the display panel and to write instruction pulses input from the input terminals X−1NA. This output voltage is supplied from the output terminals $X_l \sim X_n$ of the driver IC 1 to the X electrodes of the display panel. Therefore, the voltage according to the data or information concerned is applied between the X and Y electrodes of each dot in the display panel, and thus the discharge is caused through an inactive gas, such as argon, sealed between both electrodes and the dot to be displayed is lit. Once the dot is lit, the light-emission is maintained by a sustain pulse input from the input terminals X−1NA, Y−1NA of the driver ICs 1, 2, 3. In addition, by scanning the light-emission operation in accordance with a sequential time-division driving of the Y electrodes, information such as letters and figures obtained in accordance with the input data is displayed on the entire display panel.

However, when the gas discharge display panel is driven in the above-mentioned method, the Y electrodes of the display panel are multiplexed by the time division during the writing operation, and the voltage is applied to the electrodes via a condenser from both the $Y_l \sim Y_m$ and $Y'_l \sim Y'$ electrodes. Therefore, when the voltage applied to both these input terminals of the Y electrode is, for example, 0 V or 90 V, an intermediate voltage of approximately 45 V sometimes appears in the Y electrodes causing the half-selection.

Figure 3:
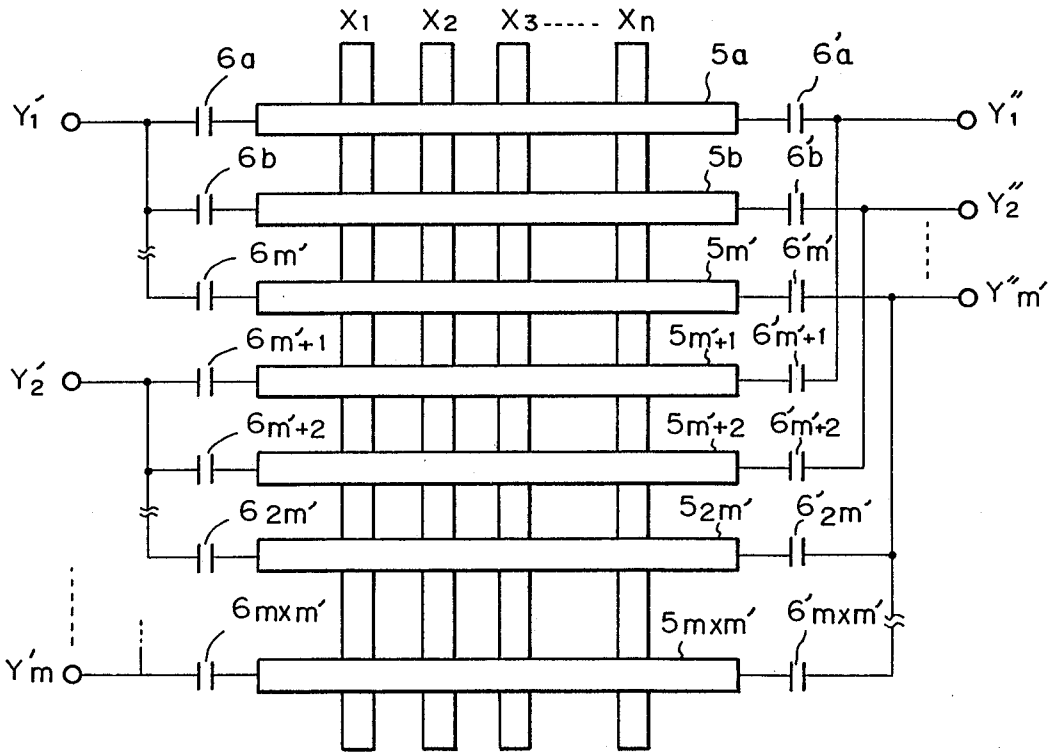
FIG. 3 shows the construction of the electrodes in a multiplexed gas discharge display panel.

FIG. 2 is a block diagram of the circuit for driving a gas discharge display panel according to the present invention. In FIG. 2, in a gas discharge display panel 4, the discharge points are arranged in parallel to the X and Y axes in a dot matrix. The X axis side has output terminals $X'_1, X'_2, \ldots X'_n$. On the Y axis side, as shown in FIG. 3, the first and second, opposite sides, or ends (i.e., the left and right sides, or ends, as seen in FIG. 3) of the display electrodes $5a \sim 5_{mxm'}$ are connected to condensers $6a \sim 6_{mxm'}$ and $6'_a \sim 6'_{mxm'}$ respectively, the other end of the condenser is connected to each terminal $Y'_l \sim Y'_m$, $Y''_l \sim Y''_{m'}$ as shown in FIG. 2. The terminals $X'_l \sim X'_n$ of the gas discharge display panel are connected to an X line driver 7, shown in FIG. 2. The X line driver 7 is connected to a logic circuit 11 which controls the X line driver 7 and is also connected to a sustain driver 9, which supplies high voltages of 90 V and 140 V to the X line driver 7. The terminals $Y'_l \sim Y'_m$, $Y''_l \sim Y''_{m'}$ of the gas discharge display panel 4 are connected to Y line drivers 10a and 10b. The Y line drivers 10a and 10b are connected to a logic circuit 8, which controls the Y line drivers 10a and 10b, and are also connected to the sustain driver 9 which supplies the high voltage of 90 V to the Y line drivers 10a and 10b. A data memory circuit 12 stores data for displaying information such as the desired letter or figure on the gas discharge display panel 4. A main controller 13 is connected to the logic circuits 8 and 11 and the sustain circuit 9, to operate each circuit at a predetermined timing.

Next, an explanation will be given of the driving method, according to the present invention, in the driving circuit for driving the gas discharge display panel having the above construction.

First, the logic circuit 11 is operated in accordance with the control of the main controller 13, and the signals for bringing all X electrodes of the gas discharge display panel 4 to a high voltage (for example, 140 V) are output from the logic circuit 11 to the line driver 7. The high voltage is supplied from the sustain driver 9 to the line driver 7 at each output corresponding to $X'_1 \sim X'_n$. Therefore, the voltage supplied from the sustain driver 9 is supplied by the line driver 7 to the X input terminals $X'_1 \sim X'_n$ of the gas discharge display panel 4 at all outputs of the line driver 7. Thus, the high voltage is supplied to all X electrodes of the gas discharge display panel 4.

FIG. 3 is a diagram showing an example of Y electrodes $5a \sim 5_{mxm'}$ multiplexed by using condensers. In a conventional operation of such a capacitor-matrix driven panel, when the electrode 5a is selected so as to light the crossing points between the electrode 5a and $X_1$, $X_3$, 0 V is applied to $Y'_l$ and $Y''_l$, the sustain voltage of 90 V is supplied to the other Y electrodes, that is except for $Y'_l$ and $Y''_l$, a write voltage of 140 V is applied to electrodes $X_1$, $X_3$, and 0 V is supplied to electrodes $X_2$, $X_n$. Thus 140 V is applied between the electrode 5a and the electrodes $X_1$, $X_3$. The voltage difference between the electrode 5a and the electrodes $X_2$, $X_n$ is 0 V therefore discharge is not caused. However, in this case, the electrodes 5b, 5m', ---, 5m'+1, are supplied by the half-selection voltage of 45 V, an opposite polarity of 45 V appears between the half-selected Y electrodes 5b, 5m', --- 5m'+1 and the non-selected electrodes $X_2$, $X_n$, and therefore, any discharge which was being maintained is thus erased.

The voltage waveform ($V_w$ (140 V) in FIGS. 4A and shows the high voltage $V_w$ to be supplied to all the X electrodes.

On the other hand, for the voltage applied to the Y electrodes of the gas discharge display panel 4, the control signal is output from the main controller 13 to the logic circuit 8. The logic circuit 8 outputs the time division output to the line drivers 10a and 10b to select the electrodes to be supplied with the various voltages from among the many Y electrodes. That is, as the Y electrodes of the gas discharge display panel 4 are selected time-divisionally and sequentially, the Y input terminals $Y'_l \sim Y'_m$ and $Y''_l$ of the gas discharge display panel 4 are multiplexedly driven. The line drivers 10a and 10b output, in accordance with the signal input from the logic circuit 8, the voltage supplied from the sustain driver 9 to the selected Y input terminals $Y'_l \sim Y'_m$ and $Y''_l$. For example, the Y electrodes $5a \sim 5_{mxm'}$ of the gas discharge display panel 4 shown in FIG. 3 are connected at the first and second opposite ends thereof, respectively via condensers $6a \sim 6'_{mxm'}$ to the Y input terminals $Y'_l \sim Y'_m$ and $Y''_l \sim Y''_{m'}$. Therefore, one electrode at a time of the Y electrodes $5a \sim 5$ mxm' which is in a time division status, can be controlled to 0 V. This voltage is shown in FIG. 4B by the solid line during the time interval $t_1$. At this time, the half-selected potential (45 V) or the non-selected potential (90 V), shown by respective dotted lines, is applied to the Y electrodes which are not selected. Therefore, 140 V is applied to all X electrodes of the gas discharge display panel 4, and one selected line of the Y electrodes becomes 0 V. Thus, all the discharge cells in the selected line have a potential difference (140 V) as shown by the solid line in FIG. 4C, and the inactive gas such as argon sealed between the two electrodes discharges and emits light. At the time $t_2$, the voltages $-V_s$, $V_s$, $-V_s$ shown in FIG. 4C are applied between the X electrodes and the Y electrodes by the sustain voltage pulse supplied from the sustain driver 9 to the X line driver 7 and the Y line driver 10a and 10b, so that the sustain discharge is effected three times and the light-emission is effected each time.

On the other hand, at the time $t_1$, either the voltage $V_w - V_s/2$ shown by the upper dotted line in FIG. 4C or the voltage $V_w - V_s$ shown by the lower dotted line is supplied to all discharge cells of the display panel 4 among the non-selected Y electrodes. These voltages $V_w - V_s/2$ and $V_w - V_s$ are both positive voltages, and the voltage applied between the X electrodes and the Y electrodes before the time $t_1$ is also a positive voltage as shown in FIG. 4C. Therefore, the wall charges formed by the prior discharge voltage are maintained.

Next, in accordance with the control of the controller 13, data such as the figure or letter to be displayed on the gas discharge display panel are input from the data memory circuit 12 to the logic circuit 11. The line driver 7, in accordance with the input signal, supplies the voltage supplied from the sustain driver 9 to the X electrodes to be erased (shown with dotted lines in FIG. 4A) among the X input terminals $X_1' \sim X_n'$ of the gas discharge display panel 4. That is, the voltage $V_s$ is supplied during the time interval $t_4$ shown in FIG. 4C. This time interval $t_4$ is about 1 μs and corresponds to the time needed for making the wall charges maintaining the discharge to become zero. As the wall charges in the discharge cell supplied with the erase pulse become zero, the discharge is not caused subsequently by the sustain voltage. Therefore, the dots not needed for the display along the one selected line of Y electrodes of the gas discharge display panel 4 can be extinguished. Thus, by holding the dots needed for the display on that one selected line of Y electrodes of the gas discharge display panel 4, the data can be written on the display panel. The once written data is maintained by the sustain pulse input from the sustain driver 9 via the line driver 7.

For the dots along the lines of Y electrodes of the groups which are not selected, the voltage of each Y electrode is either $V_s/2$ or $V_s$, and these discharge cells do not receive a positive voltage application. Thus the last discharge state, in the time interval, $t_2$ corresponding to a negative voltage, is not interfered with and therefore, the wall charges are maintained. Also at the time $t_4$, the voltage $V_s/2$ is applied to others of the non-selected Y electrodes. However, the wall charges are maintained since the time $t_4$ is short. At the time $t_5$, the sustain discharge is carried out, the wall charges are maintained, and a status is established wherein the dots emit light when the electrode is selected at the next time. Next, the logic circuit 8 is controlled by the control of the main controller 13, so that next selected line of the Y electrodes of the gas discharge display panel 4 is placed to 0 V via the line driver 10 in a manner similar to the above. Simultaneously, the voltage $V_w$ is applied to all X electrodes of the gas discharge display panel from the sustain driven 9 via the line driver 7. Therefore, the inactive gas sealed between both electrodes in all discharge cells in the next selected line of Y electrodes is discharged and emits light once. After this light-emission, similar to that mentioned above, the main controller 13 outputs data such as the figure or the letter to be displayed on the gas discharge display panel, from the data memory circuit 12 via the logic circuit 11 to the gas discharge display panel 4. Therefore, the voltage including the signal information from the data memory circuit 12 is supplied to the X electrodes, so that the dots not needed for the display are extinguished and the data is written.

Therefore, the data output from the data memory circuit is written also in the next selected line of the Y electrodes of the gas discharge display panel 4. This data is maintained until the next information is written by the light sustaining voltage pulse input from the sustain driver.

Further, the light first emitted in the lines of the Y electrodes and not needed for the display is discharged by the write voltage in a time of about 20 μs, and can be neglected, since any afterglow is not visible to the human eye.

As mentioned above, data is written by sequential lighting of the dots by the Y dot lines of the gas discharge display panel, and the written display is sustained by the sustain pulse so that the data such as the letter and figure can be displayed on the gas discharge display panel 4.

Further, the present invention can be achieved by multiplex-driving the X input terminals.

Figure 5:
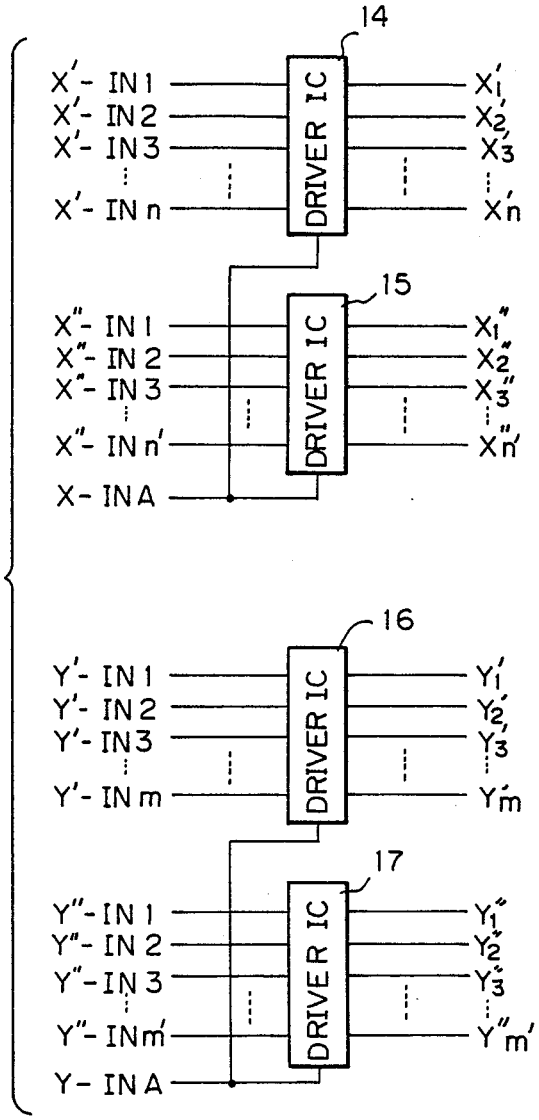
FIG. 5 shows the construction of the circuit in the gas discharge display panel in which both X and Y electrodes are multiplex-driven.

FIG. 5 is a diagram showing when the multi-drive is also effected in the X electrodes. In FIG. 5, output terminals $X'_1 \sim X'_n$ and $X''_l \sim X''_{n'}$ of drivers 14 and 15 are shown in the state before inputting to the gas discharge display panel 4 shown in FIG. 2. The construction of the input terminals $Y'_1 \sim Y'_m$ and $Y''_1 \sim Y''_{m'}$ of the gas discharge display panel 4 is the same as that shown in FIG. 2 and FIG. 3. In this case, multiplexed signals are input also to the drivers 14 and 15, and multiplexed data signals are input to input terminals $X'-1N_1 \sim X'-1N_n$ and $X''-1N_1 \sim X''-1N_{n'}$.

By controlling the multiplexed voltage input to the X side of the gas discharge display panel and the multiplexed voltage input to the Y side by the main controller 13, the voltage difference appearing between two electrodes of the gas discharge display panel 4 is discharged via the inactive gas, to cause a display on the gas discharge display panel 4.

As mentioned above, in the embodiment of the present invention, when data such as figures and letters are written on the gas discharge display panel 4, dots included in one line of the Y lines are lit, and in the next step, all unnecessary dots are extinguished. Therefore, mislighting due to the intermediate voltage appearing in the conventional driving method cannot occur.

Figure 6:
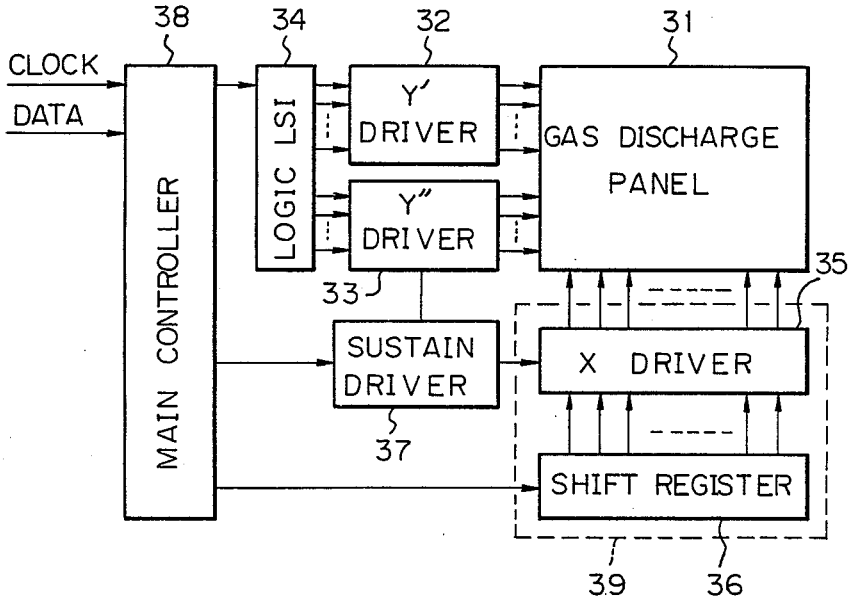
FIG. 6 shows a block diagram explaining another method according to the present invention.

FIGS. 7A–7D show the voltage waveforms employed for the embodiment of FIG. 6, to be applied to the Y' terminal and Y" terminal of the panel, wherein the sustain voltage pulse Vs is applied to all Y' and Y" terminals, and the write voltage pulse Vw and the erase voltage pulse $V_E$ is applied to each of the selected Y' and Y" terminals. FIG. 7C shows the voltage waveform applied to the X terminal. The sustain voltage pulse sequence (Vs) is applied to all terminals, and the erase cancel voltage pulse Vc is applied only to the X terminal selected in accordance with the data signal. FIG. 7D shows a floating ground voltage level of the floating circuit portion of FIG. 6.

The present invention is not restricted to the above-mentioned embodiments, in that the voltage applied to the electrodes of the gas discharge display panel may be not zero but the voltage by which the discharge can be started when there are no wall charges.

The same effect can be obtained also when only display electrodes are formed on the gas discharge display panel, and these electrodes are capacitively coupled to the driving circuit at external points.

FIG. 6 shows another embodiment of the method according to the present invention. In FIG. 6, the voltage pulses as shown in FIGS. 7A to 7D are applied. In FIG. 6, 31 designates a gas discharge display panel (each discharge point is arranged in a matrix form in parallel to the X axis and Y axis), 32 a Y' driver, 33 a Y" driver, 34 a logic LSI, 35 an X driver, 36 a shift register, 37 a sustain driver which supplies a high voltage 90 V and 140 V to the X driver 35, Y' driver 32, and Y" driver 33, 38 a main controller, and a portion 39 enclosed by a dotted line shows a floating circuit. The main controller is connected to a data memory circuit (not shown in the drawing) which stores the data for displaying the desired letter or figure, etc. on the gas discharge panel 31.

The Y' driver 32 is connected to the Y electrodes in the left side, or end, shown in FIG. 3 and the Y" driver 33 is connected to the Y electrodes in the right side, or opposite end. The write pulse and the erase pulse are supplied at the same voltage as the input voltage, but only to the display electrodes to which these pulses are applied at both the left and right sides. The half voltage of the input voltage results at the display electrodes to which the pulse is applied only on one side. The matrix drive is effected by Y' and Y", and the write pulse $V_w$ and the erase pulse $V_E$ are applied to each selected line of the display electrodes, sequentially. The X driver 35 and the shift register 36 are formed as a floating circuit which is floated to a floating ground voltage $V_{FG}$. The erase cancel voltage $V_C$ is applied to the X line to be lit and displayed corresponding to the data signal, with the timing of the erase pulse $V_E$.

By the sequence of the waveforms shown in FIGS. 7A–7D, the erase cancelling voltage $V_C$ may be smaller than one half of the sustain pulse voltage (about 90 V) FIG. 8 is a diagram showing the operating margin in an embodiment of the present invention, wherein the erase cancel voltage is shown on the X axis and the operating margin is shown on the Y axis. By using a floating gate circuit as indicated in FIG. 6, the permitted voltage of the X drivers can be made to be about 35 V, and the driver LSI can be easily realized.

According to circuit shown in FIG. 6, the number of driving circuits requiring a high voltage driver can be considerably decreased by operating with multiplexed driving using capacitive coupling and, accordingly, an IC having a low voltage can be used as the X driver. Thus a small size and low cost display apparatus can be obtained. Also, high speed display can be achieved as the apparatus can be driven by line scanning.

FIGS. 9 to 10C show another embodiment of the present invention. These drawings are similar to FIG. 5 and FIG. 7. FIGS. 10A–10C show voltage waveforms employed for the embodiment shown in FIG. 9, to be applied to a Y' terminal and a Y" terminal, repectively. Sustain voltage pulse sequences (+Vs, −Vs) are applied to all Y' and Y" terminals. The write voltage pulse Vw and the erase voltage pulse $V_E$ are applied only to each selected Y' and Y" terminal. FIG. 10C shows a voltage waveform applied to an X terminal, and an erase cancel voltage pulse Vc applied to the X terminal which is selected, in accordance with the data signal. Positive and negative sustain voltages $\pm V_s$, the write voltage pulse $V_w$, and the erase pulse $V_E$ are supplied from a Y' driver 41 and Y" driver 42, and the line selection write and erase voltage pulses are supplied to the display electrodes. At the erase pulse time, the X electrodes are maintained constantly at 0 V, except for the erase cancel pulse $V_C$ corresponding to the data signal which is selectively applied to the X electrodes. The operating characteristics such as the operating margin and the display speed are the same as in the previous embodiment. However, in the present embodiment, it is not necessary for the low voltage X driver 44 and the shift register 45 to be floating. Therefore, the floating circuit can be decreased and an apparatus having a small size and low cost can be obtained.

As explained above in detail, according to the present invention, a complicated circuit for removing the intermediate voltage appearing at the conventional gas discharge display panel using multiplexed drive is not necessary, mislighting can be removed by using a simple circuit, and both the X and Y electrodes can be multiplexed so that many light emitting dots can be driven.

Further, according to the present invention, an erase pulse is applied to one line after lighting all of the line connected in a matrix, and an erasing operation is cancelled by applying the voltage which is smaller than one half of that of a sustain voltage to opposed electrodes at the same timing as for the erase pulse. Thus a gas discharge display apparatus which is small in size and low in cost can be obtained without decreasing the operating speed.

We claim:

1. A method for driving a gas discharge display panel having a pair of first and second spaced substrates separated by a gas discharge space and respective, first and second pluralities of parallel display electrodes thereon transversely oriented to define a matrix of intersections and corresponding discharge cells therebetween, and a capacitive matrix, multiplex drive system for the display electrodes on at least the first substrate for selectively producing and thereafter maintaining discharges in the discharge cells of the panel corresponding to data to be displayed and extinguishing discharges in the discharge cells not corresponding to data to be displayed and accordingly in which discharges are not to be maintained, each display electrode having first and second opposite ends, the system comprising first and second pluralities of driving electrodes, the first and second opposite ends of each display electrode on the first substrate being individually, capacitively coupled to corresponding driving electrodes of the first and second pluralities thereof and the driving electrodes of the first plurality being connected in a first arrangement of plural first groups and the driving electrodes of the second plurality being connected in a second, different arrangement of plural second groups thereby to permit multiplexed, individual and successive selection of the display electrodes on the first substrate by successive selection of the plural driving electrodes of the first and second groups thereof, comprising the steps of:

selecting a display electrode of the first substrate with respect to which data is to be displayed by selectively producing discharges in corresponding discharge cells associated with the selected display electrode;

in a first time interval, substantially simultaneously discharging all of the discharge cells associated with the selected display electrode;

selecting all discharge cells associated with the selected display electrode of the first substrate in which discharges are not to be produced in accordance with the data to be displayed; and in a second time interval subsequent to the first time interval, erasing those discharge cells in which discharges are not to be produced while maintaining the discharges in the discharge cells associated with the selected display electrode and corresponding to the data, and thereby producing the display of the data by the selected display electrode.

2. A method as recited in claim 1 employing write voltage pulses of a first, predetermined voltage level relative to a reference voltage level and sustain voltage pulses of a second predetermined voltage level, intermediate the write pulse and reference voltage levels, wherein:

discharges, once initiated in the discharge cells, are maintained by applying to all display discharge cells of the display panel, sustain voltage pulses of alternating polarity and of a voltage level intermediate the write and reference voltage levels;

the step of discharging all of the discharge cells associated with the selected display electrode of the first substrate is performed by applying a write pulse to all of the display electrodes of the second substrate and, substantially simultaneously, maintaining the selected electrode of the first substrate at the reference voltage level while applying a voltage pulse of at least half the voltage level of the sustain voltage pulses to the remaining display electrodes of the first substrate; and the step of erasing those discharge cells associated with the selected display electrode in which discharges are not to be produced is performed by selectively and substantially simultaneously applying an erase pulse to each display electrode of the second substrate which corresponds to a discharge cell associated with the selected display electrode of the first substrate in which a discharge is not to be produced while maintaining the selected electrode of the first substrate at the reference voltage level and applying a voltage pulse of at least half the sustain voltage level to all remaining display electrodes of the first substrate.

3. The method as recited in claim 1, wherein:

the step of discharging all of the discharge cells associated with the selected display electrode of the first substrate is performed by applying a write pulse to the selected display electrode while maintaining all display electrodes of the second substrate at a reference potential thereby to produce discharges in all of the discharge cells associated with the selected display electrode of the first substrate; and the step of erasing the discharge cells associated with the selected electrode of the first substrate and in which discharges are not to be produced is performed by applying an erase voltage pulse to the selected display electrode and selectively applying an erase voltage cancellation pulse to the electrodes of the second substrate which define the data-corresponding cells associated with the selected display electrode thereby to cancel the effect of the erase voltage at the data-corresponding discharge cells associated with the selected electrode.

4. The method as recited in claim 3, further comprising applying an alternating succession of sustain pulses to the driving electrodes of the first and second substrates intermediate the first and second time intervals.

5. The method as recited in claim 3, further comprising applying an alternating succession of sustain pulses to the first and second ends of the driving electrodes of the first substrate intermediate the first and second time intervals.

6. The method as recited in claim 1, wherein:

the step of selecting one of the display electrodes of the first substrate is performed by selecting the respective first and second groups of the first and second driving electrodes respectively capacitively coupled to the first and second opposite ends of the selected display electrode.

7. The method as recited in claim 6 employing write voltage pulses of a first, predetermined voltage level relative to a reference voltage level and sustain voltage pulses of a second predetermined voltage level, intermediate the write pulse and reference voltage levels, wherein:

discharges, once initiated in the discharge cells, are maintained by applying to all display discharge cells of the display panel, sustain voltage pulses of alternating polarity and of a voltage level intermediate the write and reference voltage levels;

the step of discharging all of the cells associated with the selected display electrode is performed by applying write voltage pulses to all of the electrodes of the second substrate while, substantially simultaneously, maintaining the selected, first and second groups of the first and second driving electrodes capacitively coupled to the selected display electrode at the reference voltage level and applying a voltage pulse of the sustain voltage level to the remaining the first and second groups of first and second driving electrodes.

8. The method as recited in claim 7, wherein the step of erasing all of the discharge cells associated with the selected display electrode of the first substrate and not corresponding to the data to be displayed is performed by maintaining the respective first and second groups of driving electrodes respectively associated with the selected display electrode at the reference voltage level while applying an erase voltage pulse selectively to the display electrodes of the second substrate which define the non-data corresponding discharge cells associated with the selected display electrode and, substantially simultaneously, applying a voltage pulse of substantially the sustain voltage pulse level to the remaining first and second groups of driving electrodes.

9. A method for driving a gas discharge display panel having a pair of first and second spaced substrates separated by a gas discharge space and respective, first and second pluralities of parallel display electrodes thereon transversely oriented to define a matrix of intersections and corresponding discharge cells therebetween, and a capacitive matrix, multiplex drive system for the display electrodes on at least the first substrate for selectively producing and thereafter maintaining discharges in the discharge cells of the panel corresponding to data to be displayed and extinguishing discharges in the discharge cells not corresponding to data to be displayed and accordingly in which discharges are not to be maintained, each display electrode having first and second opposite ends, the system employing write voltage pulses of a first, predetermined voltage level relative to a reference voltage level and sustain voltage pulses of a second predetermined voltage level, intermediate the write pulse and reference voltage levels, and comprising first and second pluralities of driving electrodes, the first and second opposite ends of each display electrode on the first substrate being individually, capacitively coupled to corresponding driving electrodes of the first and second pluralities thereof and the driving electrodes of the first plurality being connected in a first arrangement of plural first groups and the driving electrodes of the second plurality being connected in a second, different arrangement of plural second groups thereby to permit multiplexed, individual and successive selection of the display electrodes on the first substrate by successive selection of the plural driving electrodes of the first and second groups thereof, each the group of driving electrodes having a common signal terminal, wherein discharges, once initiated in the discharge cells, are maintained by applying to all discharge cells sustain voltage pulses of alternating polarity and of a voltage level intermediate the write and reference voltage levels, comprising the steps of:

selecting a given display electrode of the first substrate by selecting the common signal terminals of the respective first and second groups of driving electrodes associated with the given display electrode;

applying a write voltage pulse to all display electrodes of the second substrate while simultaneously maintaining a reference voltage level at the common signal terminals of the respective first and second groups of driving electrodes associated with the selected, given display electrode and, substantially simultaneously, applying a voltage pulse of substantially a sustain voltage pulse level to the remaining first and second group terminals, thereby to produce a discharge in each discharge cell associated with the selected display electrode and to sustain discharges in all remaining discharge cells of the panel; and applying a reference voltage level to the respective first and second group terminals associated with the selected display electrode and, substantially simultaneously, applying an erase signal pulse to each of the display electrodes of the second substrate which define non-data corresponding discharge cells associated with the selected display electrode thereby to erase each discharge initiated in a non-data corresponding discharge cell, and applying a voltage pulse of substantially a sustain voltage pulse level to the remaining first and second group terminals, thereby to cancel the effect of the erase signal pulse as to all remaining discharge cells of the panel.

10. The method of claim 9, further comprising:

selecting successive display electrodes of the first substrate in accordance with selecting each of the second group terminals in individual succession, for each of the first group terminals and in accordance with the successive selection of the first group terminals in individual succession; and selectively producing discharges in the data-corresponding discharge cells of each successively selected display electrode of the second substrate, as aforesaid.

11. The method for driving a gas discharge display panel having a pair of first and second spaced substrates separated by a gas discharge space and respective, first and second pluralities of parallel display electrodes thereon transversely oriented to define a matrix of intersections and corresponding discharge cells therebetween, and a capacitive matrix, multiplex drive system for the display electrodes on at least the first substrate for selectively producing and thereafter maintaining discharges in the discharge cells of the panel corresponding to data to be displayed and extinguishing discharges in the discharge cells not corresponding to data to be displayed and accordingly in which discharges are not to be maintained, each display electrode having first and second opposite ends, the system employing write voltage pulses of a first, predetermined voltage level relative to a reference voltage level and sustain voltage pulses of a second predetermined voltage level, intermediate the write pulse and reference voltage levels, and comprising first and second pluralities of driving electrodes, the first and second opposite ends of each display electrode on the first substrate being individually, capacitively coupled to corresponding driving electrodes of the first and second pluralities thereof and the driving electrodes of the first plurality being connected in a first arrangement of plural first groups and the driving electrodes of the second plurality being connected in a second, different arrangement of plural second groups thereby to permit multiplexed, individual and successive selection of the display electrodes on the first substrate by successive selection of the plural driving electrodes of the first and second groups thereof, each the group of driving electrodes having a common signal terminal, wherein discharges, once initiated in the discharge cells, are maintained by applying to all discharge cells sustain voltage pulses of alternating polarity and of a voltage level intermediate the write and reference voltage levels, comprising the steps of:

selecting a given display electrode of the first substrate by selecting the common signal terminals of the respective first and second groups of driving electrodes associated with the given display electrode;

applying a write voltage pulse to the common signal terminals of the respective first and second groups of driving electrodes associated with the selected display electrode while maintaining all the electrodes of the second substrate at a reference voltage level thereby to initiate a discharge in each discharge cell associated with the selected display electrode; and applying an erase voltage pulse to the common signal terminals of the respective first and second groups of driving electrodes associated with the selected display electrode and, substantially simultaneously, selectively applying an erase cancel voltage pulse to the display electrodes of the second substrate which define discharge cells associated with the selected display electrode of the first substrate which correspond to the data to be displayed to cancel the effect of the erase pulse and thereby to maintain the discharge initiated in each data-corresponding discharge cell associated with the selected display electrode, the erase pulse erasing the discharges initiated in the remaining, non-data corresponding discharge cells associated with the selected display electrode, and thereby producing a display of the data.

12. The method of claim 11, further comprising:

selecting successive display electrodes of the first substrate in accordance with selecting each of the second group terminals in individual succession, for each of the first group terminals and in accordance with the successive selection of the first group terminals in individual succession; and selectively producing discharges in the data-corresponding discharge cells of each successively selected display electrode of the second substrate, as aforesaid.

13. A system for driving a gas discharge display panel having a pair of first and second spaced substrates separated by a gas discharge space and respective, first and second pluralities of parallel display electrodes thereon transversely oriented to define a matrix of intersections and corresponding discharge cells therebetween, and a capacitive matrix, multiplex drive system for the display electrodes on at least the first substrate for selectively producing and thereafter maintaining discharges in the discharge cells of the panel corresponding to data to be displayed and extinguishing discharges in the discharge cells not corresponding to data to be displayed and accordingly in which discharges are not to be maintained, each display electrode having first and second opposite ends, the system comprising first and second pluralities of driving electrodes, the first and second opposite ends of each display electrode on the first substrate being individually, capacitively coupled to corresponding driving electrodes of the first and second pluralities thereof and the driving electrodes of the first plurality being connected in a first arrangement of plural first groups and the driving electrodes of the second plurality being connected in a second, different arrangement of plural second groups thereby to permit multiplexed, individual and successive selection of the display electrodes on the first substrate by successive selection of the plural driving electrodes of the first and second groups thereof, comprising:

first means for selecting a display electrode of the first substrate with respect to which data is to be displayed by selectively producing discharges in corresponding discharge cells associated with the selected display electrode and for substantially simultaneously discharging all of the discharge cells associated with the selected display electrode in a first time interval; and second means for selecting all discharge cells associated with the selected display electrode of the first substrate in which discharges are not to be produced in accordance with the data to be displayed, and for erasing those discharge cells in which discharges are not to be produced while maintaining the discharges in the discharge cells associated with the selected display electrode and corresponding to the data in a second time interval subsequent to the first time interval, and thereby producing the display of the data by the selected display electrode.

14. A system as recited in claim 13 employing write voltage pulses of a first, predetermined voltage level relative to a reference voltage level and sustain voltage pulses of a second predetermined voltage level, intermediate the write pulse and reference voltage levels, wherein discharges, once initiated in the discharge cells, are maintained by applying to all display discharge cells of the display panel, sustain voltage pulses of alternating polarity and of a voltage level intermediate the write and reference voltage levels and wherein:

said first means further comprises means for applying a write pulse to all of the display electrodes of the second substrate and, substantially simultaneously, maintaining the selected electrode of the first substrate at the reference voltage level while applying a voltage pulse of at least half the value of the sustain voltage to the remaining display electrodes of the first substrate; and said second means further comprises means for selectively and substantially simultaneously applying an erase pulse to each display electrode of the second substrate which corresponds to a discharge cell associated with the selected display electrode of the first substrate in which a discharge is not to be produced while maintaining the selected electrode of the first substrate at the reference voltage level and applying a voltage pulse of at least half the sustain voltage level to all remaining display electrodes of the first substrate.

15. The system as recited in claim 13, wherein:

the first means further comprises means for applying a write pulse to the selected display electrode while maintaining all display electrodes of the second substrate at a reference potential thereby to produce discharges in all of the discharge cells associated with the selected display electrode of the first substrate; and said second means further comprises means for applying an erase voltage pulse to the selected display electrode and selectively applying an erase voltage cancellation pulse to the electrodes of the second substrate which define the data-corresponding cells associated with the selected display electrode thereby to cancel the effect of the erase voltage at the data-corresponding discharge cells associated with the selected electrode.

16. The system as recited in claim 13 employing write voltage pulses of a first, predetermined voltage level relative to a reference voltage level and sustain voltage pulses of a second predetermined voltage level, intermediate the write pulse and reference voltage levels, wherein discharges, once initiated in the discharge cells, are maintained by applying to all display discharge cells of the display panel, sustain voltage pulses of alternating polarity and of a voltage level intermediate the write and reference voltage levels and wherein said first means further comprises:

means for selecting the respective first and second groups of the first and second driving electrodes respectively capacitively coupled to the first and second opposite ends of the selected display electrode; and means for applying write voltage pulses to all of the electrodes of the second substrate while, substantially simultaneously, maintaining the selected, first and second groups of the first and second driving electrodes capacitively coupled to the selected display electrode at the reference voltage level and applying a voltage pulse of the sustain voltage level to the remaining the first and second groups of first and second driving electrodes.

17. The system as recited in claim 16, wherein said second means further comprises:

means for maintaining the respective first and second groups of driving electrodes respectively associated with the selected display electrode at the reference potential while applying an erase voltage pulse selectively to the display electrodes of the second substrate which define the discharge cells associated with the selected display electrode and not corresponding to the data to be displayed and, substantially simultaneously, applying a voltage pulse of substantially the sustain voltage pulse level to the remaining first and second groups of driving electrodes.

18. A system for driving a gas discharge display panel having a pair of first and second spaced substrates separated by a gas discharge space and respective, first and second pluralities of parallel display electrodes thereon transversely oriented to define a matrix of intersections and corresponding discharge cells therebetween, and a capacitive matrix, multiplex drive system for the display electrodes on at least the first substrate for selectively producing and thereafter maintaining discharges in the discharge cells of the panel corresponding to data to be displayed and extinguishing discharges in the discharge cells not corresponding to data to be displayed and accordingly in which discharges are not to be maintained, each display electrode having first and second opposite ends, the system employing write voltage pulses of a first, predetermined voltage level relative to a reference voltage level and sustain voltage pulses of a second predetermined voltage level, intermediate the write pulse and reference voltage levels, and comprising first and second pluralities of driving electrodes, the first and second opposite ends of each display electrode on the first substrate being individually, capacitively coupled to corresponding driving electrodes of the first and second pluralities thereof and the driving electrodes of the first plurality being connected in a first arrangement of plural first groups and the driving electrodes of the second plurality being connected in a second, different arrangement of plural second groups thereby to permit multiplexed, individual and successive selection of the display electrodes on the first substrate by successive selection of the plural driving electrodes of the first and second groups thereof, each the group of driving electrodes having a common signal terminal, wherein discharges, once initiated in the discharge cells, are maintained by applying to all discharge cells sustain voltage pulses of alternating polarity and of a voltage level intermediate the write and reference voltage levels, comprising:

first means for selecting a given display electrode of the first substrate by selecting the common signal terminals of the respective first and second groups of driving electrodes associated with the given display electrode and for applying a write voltage pulse to all display electrodes of the second substrate while simultaneously maintaining a reference voltage level at the common signal terminals of the respective first and second groups of driving electrodes associated with the selected, given display electrode and, substantially simultaneously, applying a voltage pulse of substantially a sustain voltage pulse level to the remaining first and second group terminals, thereby to produce a discharge in each discharge cell associated with the selected display electrode and to sustain discharges in all remaining discharge cells of the panel; and second means for applying a reference level potential to the respective first and second group terminals associated with the selected display electrode and substantially simultaneously applying an erase signal pulse to each of the display electrodes of the second substrate which define non-data corresponding discharge cells associated with the selected display electrode thereby to erase each discharge initiated in a non-data corresponding discharge cell, and applying a voltage pulse of substantially a sustain voltage pulse level to the remaining first and second group terminals, thereby to cancel the effect of the erase signal pulse as to all remaining discharge cells of the panel.

19. A system for driving a gas discharge display panel having a pair of first and second spaced substrates separated by a gas discharge space and respective, first and second pluralities of parallel display electrodes thereon transversely oriented to define a matrix of intersections and corresponding discharge cells therebetween, and a capacitive matrix, multiplex drive system for the display electrodes on at least the first substrate for selectively producing and thereafter maintaining discharges in the discharge cells of the panel corresponding to data to be displayed and extinguishing discharges in the discharge cells not corresponding to data to be displayed and accordingly in which discharges are not to be maintained, each display electrode having first and second opposite ends, the system employing write voltage pulses of a first, predetermined voltage level relative to a reference voltage level and sustain voltage pulses of a second predetermined voltage level, intermediate the write pulse and reference voltage levels, and comprising first and second pluralities of driving electrodes, the first and second opposite ends of each display electrode on the first substrate being individually, capacitively coupled to corresponding driving electrodes of the first and second pluralities thereof and the driving electrodes of the first plurality being connected in a first arrangement of plural first groups and the driving electrodes of the second plurality being connected in a second, different arrangement of plural second groups thereby to permit multiplexed, individual and successive selection of the display electrodes on the first substrate by successive selection of the plural driving electrodes of the first and second groups thereof, each the group of driving electrodes having a common signal terminal, wherein discharges, once initiated in the discharge cells, are maintained by applying to all discharge cells sustain voltage pulses of alternating polarity and of a voltage level intermediate the write and reference voltage levels, comprising:

first means for selecting a given display electrode of the first substrate by selecting the common signal terminals of the respective first and second groups of driving electrodes associated with the given display electrode and for applying a write voltage pulse to the common signal terminals of the respective first and second groups of driving electrodes associated with the selected display electrode while maintaining all the electrodes of the second substrate at a reference voltage level thereby to initiate a discharge in each discharge cell associated with the selected display electrode; and second means for applying an erase voltage pulse to the common signal terminals of the respective first and second groups of driving electrodes associated with the selected display electrode and, substantially simultaneously, selectively applying an erase cancel voltage pulse to the display electrodes of the second substrate which define discharge cells associated with the selected display electrode of the first substrate which correspond to the data to be displayed to cancel the effect of the erase pulse and thereby to maintain the discharge initiated in each the data-corresponding discharge cell associated with the selected display electrode, the erase pulse erasing the discharges initiated in the remaining discharge cells associated with the selected display electrode and not corresponding to the data to be displayed, and thereby producing a display of the data.

* * * * *

UNITED STATES PATENT AND TRADEMARK OFFICE

CERTIFICATE OF CORRECTION

PATENT NO. : 4,900,987

DATED : February 13, 1990

INVENTOR(S) : Akira OTSUKA et al.

It is certified that error appears in the above-identified patent and that said Letters Patent is hereby corrected as shown below:

Col. 3, line 18, change "$Y_1$-$Y_m$, $Y'_1$-$Y'_m$," to --$Y_1$-$Y_m$, $Y'_1$-$Y'_m$,--;
lines 20-21, change "Y-1$N_1$-Y-1$N_m$ and Y'-1$N_1$-Y'-1$N_m$," to --Y-I$N_1$-Y-I$N_m$ and Y'-I$N_1$-Y'-I$N_m$,--;
lines 26 and 30, change "$Y_1$-$Y_m$, $Y'_1$-$Y'_m$," to --$Y_1$-$Y_m$, $Y'_1$-$Y'_m$,--;
line 36, change "ect." to --etc.--;
line 37, change "X-1$N_1$-X-1$N_n$" to --X-I$N_1$-X-I$N_n$--;
line 41, change "$X_1$-$X_n$" to --$X_1$-$X_n$--;
line 60, change "$Y_1$-$Y_m$, $Y'_1$-Y'" to --$Y_1$-$Y_m$, $Y'_1$-$Y'_m$,--.

Col. 4, lines 8 and 14-15, change "$Y'_1$-$Y'_m$, $Y''_1$-$Y''_m$'" to --$Y'_1$-$Y'_m$, $Y''_1$-$Y''_m$,--;
line 9, change "$X'_1$-$X'_n$" to --$X'_1$-$X'_n$--;
line 47, change "5ais" to --5a is--;
line 49, change "$Y'_1$-$Y''_1$" to --$Y'_1$-$Y''_1$--;
line 56, change "V" to --V, and--;
line 63, change "($V_w$(140V) in FIGS. 4A and" to --in FIG. 4A--;
line 64, change "$V_w$" to --$V_w$(140V)--.

Col. 5, lines 7 and 11-12, change "$Y'_1$-$Y'_m$ and $Y''_1$" to --$Y'_1$-$Y'_m$ and $Y''_1$-$Y''_m$,--;
line 16, change "$Y'_1$-$Y'_m$ and $Y''_1$-$Y''_m$'" to --$Y'_1$-$Y'_m$ and $Y''_1$-$Y''_m$,--.

UNITED STATES PATENT AND TRADEMARK OFFICE

CERTIFICATE OF CORRECTION

PATENT NO. : 4,900,987

DATED : February 13, 1990

INVENTOR(S) : Akira OTSUKA et al.

It is certified that error appears in the above-identified patent and that said Letters Patent is hereby corrected as shown below:

Col. 6, line 22, change "driven" to --driver--;
line 56, change "$X''_1$-$X''_n$'" to --$X''_1$-$X''_n$'--.

Signed and Sealed this

Eleventh Day of February, 1992

*Attest:*

HARRY F. MANBECK, JR.

*Attesting Officer*

*Commissioner of Patents and Trademarks*